United States Patent [19]

Sutherland

[11] 4,386,699

[45] Jun. 7, 1983

[54] BOTTLE PACKAGE

[75] Inventor: Robert L. Sutherland, Campbell Hall, N.Y.

[73] Assignee: Federal Paper Board Co., Inc., Montvale, N.J.

[21] Appl. No.: 219,598

[22] Filed: Dec. 24, 1980

[51] Int. Cl.[3] ..... B65D 5/04; B65D 65/22; B65D 71/00

[52] U.S. Cl. ..... 206/434; 229/40

[58] Field of Search ..... 206/434; 229/40

[56] References Cited

U.S. PATENT DOCUMENTS

| | | | |
|---|---|---|---|
| Re. 26,750 | 1/1970 | Ganz | 53/398 |
| 3,085,377 | 4/1963 | Ganz | 53/398 |
| 3,456,420 | 7/1969 | Ganz | 53/398 |
| 3,474,590 | 10/1969 | Ganz | 53/398 |
| 3,640,448 | 2/1972 | Wood | 229/40 |
| 4,164,286 | 8/1979 | Sutherland | 229/40 |

*Primary Examiner*—William Price
*Assistant Examiner*—Brenda J. Ehrhardt
*Attorney, Agent, or Firm*—FitzGibbon, Roehrig, Greenawalt & Stone

[57] ABSTRACT

A package and a method of forming the same wherein an assembly of articles, in the form of bottles, arranged in double row relation, is enclosed in a tubular wrapper which is formed from a blank of paperboard, or the like, cut and scored to fold about the top, opposite sides, and bottom of the article assembly, with the bottom wall forming ends of the blank having narrow hinged marginal panels, one of which is adapted to be swung to an upwardly extending position between the rows of articles and form a separating partition while the other one has locking and latching tabs on its opposite side edges which are adapted to be engaged in interlocking relation in cooperating locking and latching apertures in portions of the associated bottom wall forming panel. Article separating tabs are cut in part from the top wall panel and are adapted to be swung to partition forming relation between the top portions of the articles in the rows.

6 Claims, 8 Drawing Figures

BOTTLE PACKAGE

This invention relates to packaging and is more particular concerned with improvements in the wrapping of a plurality of articles which are in the form of bottles, by folding about an assembly of articles, which are arranged in double row and transversely aligned pairs, a cut and scored blank of paperboard, or similar foldable sheet material, so as to encompass the top, opposite sides and bottom of the assembly and connecting the end panels of the blank by interengaging locking elements thereon while the panels are tightly drawn about the article assembly so as to form a tightly wrapped package.

BACKGROUND OF THE INVENTION

In the packaging of multiple units of articles, such as, beverage bottles or cans and other products of a similar nature, many different packaging arrangements have been proposed and a substantial number have been produced in large quantities commercially. In one form of package, which has been used extensively for packaging beverages in bottles or cans, a paperboard blank is cut and scored so as to divide it into wall panels which are provided with bottle or can retention apertures and which are positioned about the four sides of an assembly of the articles in double row formation and held under tension while the end panels are interlocked to form a tight package. The tensioning of the panels may be accomplished by interengaging cooperating male and female locking elements so as to draw the panels tightly about the assembly. Such an arrangement of this type is shown in U.S. Pat. No. Re. 26,750 granted Jan. 6, 1980. Another arrangement for enclosing a plurality of bottles in a wrap-around blank involves tensioning the panels by the application of exterior force while locking and latching elements are interengaged. Such an arrangement is shown in U.S. Pat. Nos. 3,085,377 granted Apr. 16, 1963; 3,456,420 granted July 22, 1969 and 3,474,590 granted Oct. 28, 1969. While these prior arrangements have formed the basis for successful commercial operations there is a need for further development of packaging systems for articles of the type described which will employ an economical blank structure, which will provide a tightly wrapped package, which will enable the package to be formed on high speed packaging machinery, and which will enable the packaging system to be used for a greater variety of bottled products.

It is a general object of the invention to provide a package and a method of forming the same which is particularly adapted for multi-unit packaging of products which are marketed in containers having the shape of bottles or cans or having a similar configuration, which is economical of material, which employs mechanical locking elements; which satisfies the requirements for a tight wrapped package, and which lends itself to high speed wrapping machine operations.

It is a more specific object of the invention to provide an improved package and a method of forming the same which is adaptable to the packaging of a group of articles, such as bottles, cans, or the like, wherein the articles are arranged in double row relation and enclosed in a foldable wrapper blank which is cut and scored to permit it to be wrapped about the top, bottom and sides of the articles in the form of a tube and secured in tight relation by engaging associated locking and latching tab members on a terminal wall forming panel portion in cooperating locking and latching apertures cut in portions of an associated terminal wall forming panel.

Another object of the invention is to provide a wrapper forming blank and a method of applying the same to an assembly of articles having the form of bottles or cans so as to enclose the articles in a tubular carton, wherein the ends of the blank have narrow terminal hinged panels with the one hinged panel adapted to be positioned in vertical, partition forming relation between the article rows and the other hinged panel being provided with locking and latching tabs along its opposite side edges which are adapted to be engaged in cooperating locking and latching apertures in the bottom wall forming portion of the associated panel and in a tab member cut from the partition forming terminal panel and extending in the plane of the bottom wall forming panel portions.

A further object of the invention is to provide a package of the type described wherein a vertical partition panel is cut, at least in part, in the top wall forming panel and hinged into position for separating top portions of transversely aligned articles.

The invention as disclosed and claimed herein comprises a package and a method of forming the same wherein an assembly of articles in the form of bottles are enclosed in an open ended tubular carton by wrapping a cut and scored blank of foldable sheet material about an assembly of the articles, arranged in double row relation, and connecting the ends of the blank, with a relatively narrow hinged end panel portion at one end of the blank disposed in partition forming relation between the two rows of articles and with a relatively narrow end panel portion on the opposite end of the blank having locking and latching elements along its opposite side edges which are engaged in cooperating locking and latching apertures cut in the blank end portion which carries the partition forming end panel portion.

The aforesaid objects and advantages of the invention will become more apparent when reference is made to the accompanying detailed description of the preferred embodiment of the invention which is set forth therein, by way of example, and shown in the accompanying drawings wherein like reference numerals indicate corresponding parts throughout.

DESCRIPTION OF THE PREFERRED EMBODIMENT OF THE INVENTION

Figure 1:
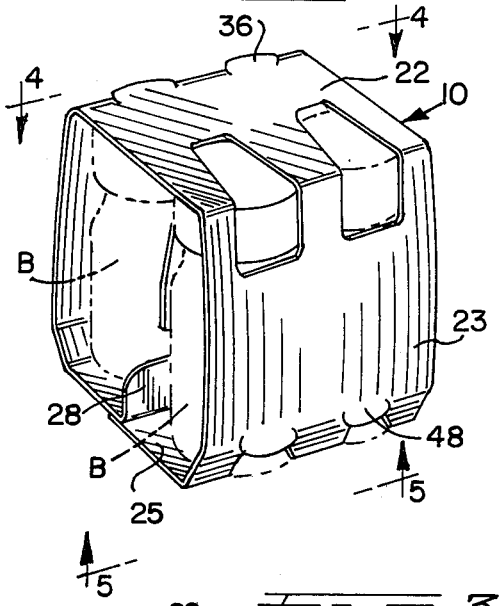
FIG. 1 is a perspective view of a package which embodies the principle feature of the invention, the articles which are shown in phantom line being in the form of conventional pill bottles.
Figure 2:
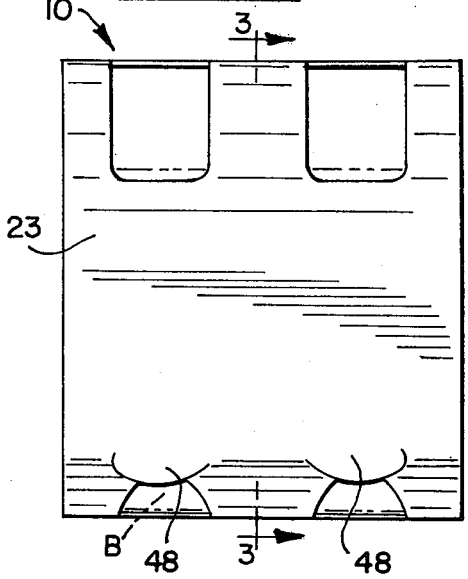
FIG. 2 is a side elevation of the package of FIG. 1.
Figure 3:
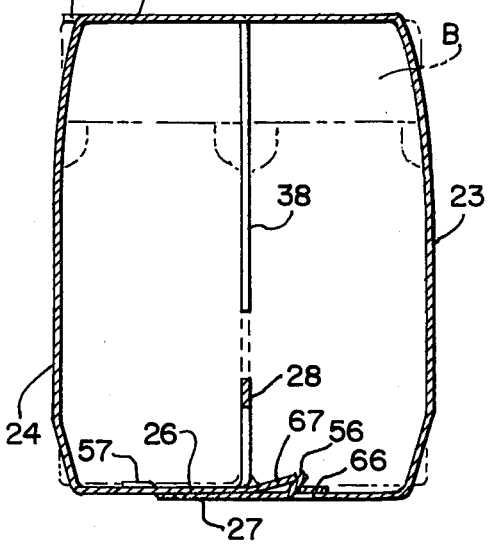
FIG. 3 is a cross-sectional view taken on the line 3—3 of FIG. 2.
Figure 4:
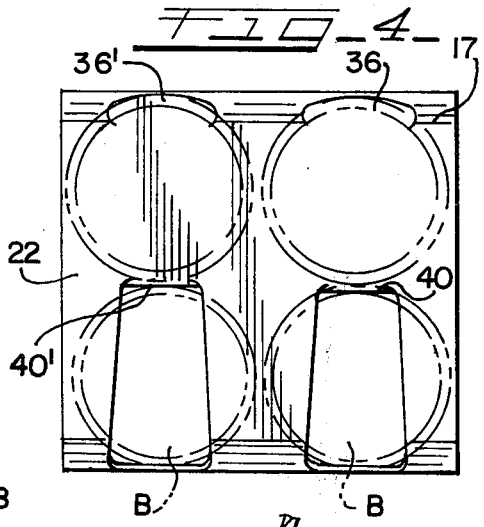
FIG. 4 is a top plan view of the package of FIG. 1.

Referring to the drawings, there is illustrated a package 10 and a method of forming the same which embodies the principle features of the invention. The illustrated package comprises an assembly of four bottles "B" enclosed in an open ended tubular carton which is formed by wrapping about the bottles while the bottles are grouped in double row, transversely aligned pairs, a cut and scored blank 12 of paperboard, or similar foldable sheet material, and securing the ends of the blank in a manner which results in the carton walls being tightly drawn about the group of bottles so as to form a tightly wrapped package and insure that the bottles will be retained in the carton under normal handling of the package. The bottles shown have the form of conventional pill bottles and wall forming panels are provided with apertures for receiving edge portions at the top and bottom of the bottles when the panels are tightly drawn so as to retain the same in the carton. It will be understood that the principles of the invention may be otherwise applied, and that the following description of the package and the method of forming the same is for the purpose of setting forth the form of the invention which is presently preferred.

Figure 7:
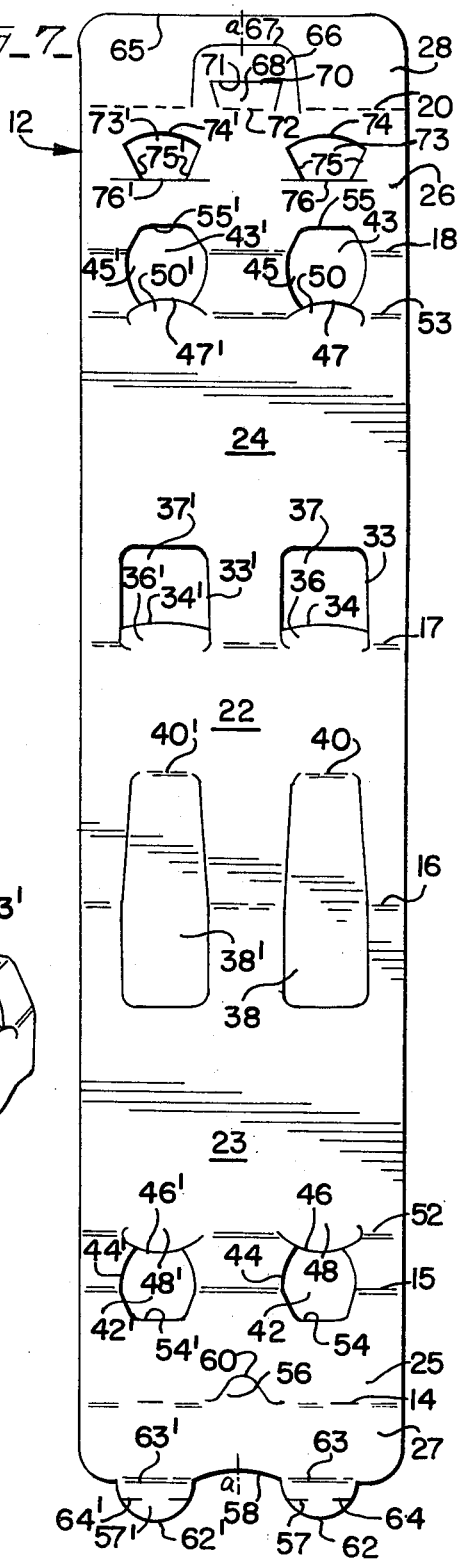
FIG. 7 is a plan of the inside face of a paperboard blank which is cut and scored preparatory to forming the four bottle package of FIG. 1.
Figure 8:
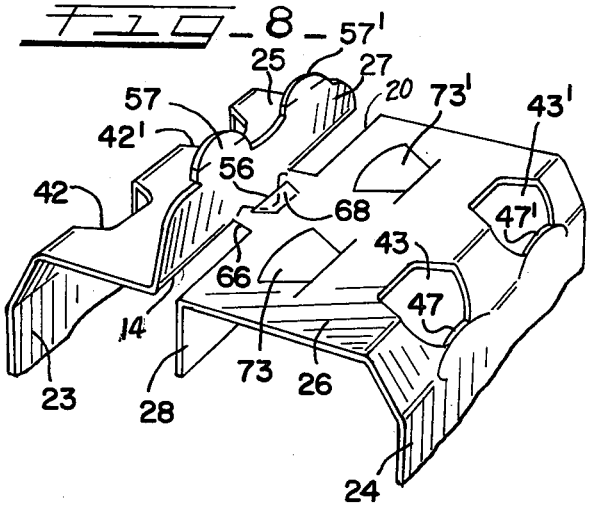
FIG. 8 is a perspective view showing the bottom wall forming panels in position and the one locking element partially engaged in the cooperating locking aperture.

The package structure 10 which is illustrated in FIGS. 1-5 is formed by wrapping the cut and scored blank 12 of FIG. 7 about the group, assembly or cluster of four bottles "B" which are arranged in double row and in transversely paired alignment, and securing the ends of the blank while the bottom wall forming panels are drawn inwardly of the side wall panels by the locking and latching operations. The bottles "B" as indicated in phantom line are a well known type which is generally used for products, such as, pills or tablets of various kinds and which have closure caps with a diameter approximately the same as the cross sectional diameter of the body of the bottles. It will be understood that the blank may be modified to adapt it to the packaging of beverage bottles and other articles of similar configuration.

The blank 12 is an elongated rectangular sheet of paperboard or other foldable sheet material, which is of suitable weight or gauge and which is cut and scored as shown in FIG. 7. The blank is cut and scored so that it is symmetrical about a longitudinal center line a—a running intermediate its side edges. It is divided into panels by longitudinally spaced hinge forming score lines 14, 15, 16, 17, 18 and 20, which extend in parallel relation transversely of the blank, and divide it into a top wall forming center panel section 22, adjoining side wall forming panel sections 23 and 24 and bottom wall forming end panels sections 25 and 26. The end panel sections 25 and 26 have at their terminal end portions end panel strips 27 and 28 of relatively narrow width, the inner edges of which are defined by the hinge-score lines 14 and 20, respectively. The end panel strips 27 and 28, as shown, have approximately equal width, that is, equal dimensions in the direction longitudinally of the blank. Strip 28 at the one end of the blank serves as a bottle bottom separating partition panel while strip 27 at the other end of the blank constitutes a locking and latching panel as hereinafter described.

The wall forming panels 22, 23, 24, 25 and 26 are cut and scored to provide identical bottle retention openings for each pair of the bottles, which are in alignment longitudinally of the blank and on opposite sides of the longtitudinal center line a—a. Also, locking and latching elements are provided which are engageable by manipulation of the bottom wall panel connecting strip member 27. Since the bottle retention means and certain of the locking and latching means on opposite sides of the center line a—a are of the same construction, elements on one side of center line a—a which are identical with corresponding elements on the other side thereof, will be identified by the same numerals primed.

The transverse hinge-score lines 16 and 17 which define corner forming edges of the top wall forming panel 22 are spaced apart in the longitudinal direction of the blank 12 a distance which is less than the combined diametrical dimension of the pair of caps on the bottles "B." The scoreline 17 is interrupted by a pair of U-shaped cutting lines 33 and 33' which are spaced transversely of the blank, so to align with the bottles. The cutting lines 33 and 33' extend into the side wall forming panel 24 with the legs of the U terminating at the transverse score line 17. Transversely extending, bowed cutting lines 34 and 34' connect the leg portions of the cutting lines 33, 33' and are offset relative to the score line 17, in the longitudinal direction of the blank, so as to provide short extension tabs 36 and 36' in the plane of the top wall forming panel 22 and bottle retention openings 37 and 37' in the side wall panel 24, when the panels are in the carton forming position, in which portions of the top edges of the bottles will be seated. A pair of bottle top separating tabs 38 and 38', which are generally rectangular and of substantial dimensions, are cut partly in the side wall panel 23 and partly in the top wall panel 22. These tabs 38 and 38' are cut so as to align with the bottles and to hinge on score lines 40 and 40' which extend transversely of and approximately on the transverse center line of the panel 22. They are positioned for swinging into a plane normal to the plane of panel 22 so as to form a separator between the top portions of each pair of transversely aligned bottles.

The side wall forming panels 23 and 24 are cut in an identical manner to provide pairs of transversely spaced bottle retention openings 42, 42' and 43, 43' at the hinge forming score lines 15 and 18 which score lines 15 and 18 define the bottom side edges of the bottle enclosing tubular carton when it is formed. The distance between the hinge lines 15 and 16 and the hinge lines 17 and 18 will correspond to the height or vertical dimension of the bottles "B." The openings 42, 42' and 43, 43' are formed in an identical manner and each pair thereof is spaced transversely of the blank so to align with the bottles. These openings are formed by cutting on generally U-shaped or C-shaped lines 44, 44' and 45, 45' which extend into the panels 25 and 26 with the ends thereof terminating at the transversely aligned cutting lines 46, 46' and 47, 47'. The latter may be in the form of circular segments corresponding to the curvature of the bottle bottom edges and result in tab formations 48, 48' and 50, 50', which extend from the bottom wall forming panels 25 and 26. The ends of transverse cutting lines 46, 46' and 47, 47' terminate at transverse score lines 52 and 53 which are parallel with and spaced from score lines 15 and 18 and which are interrupted by the cutting lines 46, 46' and 47, 47'. The cutting lines 44, 44' and 45, 45' extend into the bottom wall forming panels, 25, 26 so that edges 54, 54' and 55, 55' are spaced from the bottom edge forming hinge score lines 15 and 18.

The two end sections or panel portions 25 and 26 which extend from the score lines 15 and 18, respectively, have different longitudinal dimensions and are subdivided by the score lines 14 and 20 to provide the relatively narrow end panels 27 and 28 which are utilized in forming the package to draw the panels into tight engagement about the assembly of bottles and to lock with the adjoining panel portions so as to cooperate therewith in forming the bottom wall of the bottle enclosing carton formation, as hereinafter described.

The wall forming panel section 25 has a dimension between the score lines 14 and 15 which is somewhat less than the diameter of the bottom of the bottle while the dimension of the terminal end panel 27 in the same direction of the blank, which carries locking and latching elements is predetermined so that it may be handled or manipulated as hereinafter described. The terminal end panel 27 is divided from the bottom wall forming panel section 25 by the transverse score line 14 and is provided with locking and latching elements which include a single tab element 56 extending from the hinge score line 14 in the plane of the panel section 25, in the direction of the center of the blank, and on the center line a—a. A pair of tab elements 57, 57' extend outboard of the end edge 58 of the blank, and are spaced on opposite sides of the center line a—a according to the spacing of the bottles. These tab elements may be termed primary and secondary locking elements. Primary locking tab elements 56 is spaced along the transverse hinge forming edge of the blank and midway between the secondary locking and latching tab elements 57, 57' which are associated with it. The locking tab element 56 is formed by a generally C-shaped cutting line 60 extending to the bottom wall forming portion of panel 25 with its ends terminating at the hinge forming line 14 which defines one edge of the locking panel 27. The tab element 56 is of a size to engage in a cooperating locking aperture which is cut in panel 28 and which is hereinafter described. The secondary locking and latching tab elements 57 and 57' which are cut on semi circular lines 62, 62' and extend outboard the end edge 58 of the blank are adapted to hinge on transversely aligned hinge score lines 63, 63' which are approximately aligned with the end edge 58 of the blank. The tabs 57, 57' each have small slits 64 extending inwardly of the side edges.

Figure 5:
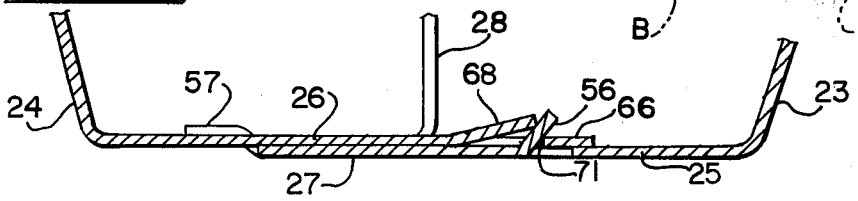
FIG. 5 is a partial cross-sectional view showing the bottom portion of FIG. 3 to a greatly enlarged scale.
Figure 6:
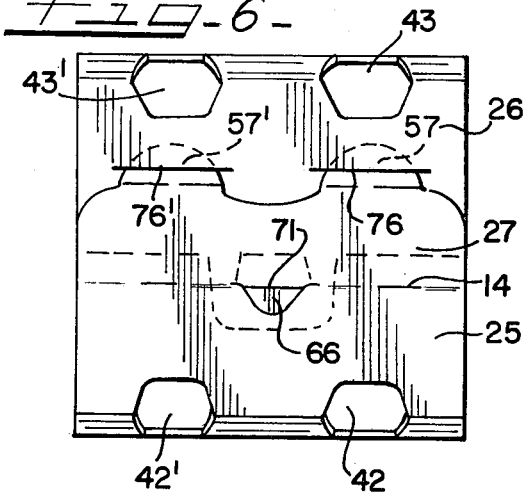
FIG. 6 is a bottom plan view of the package of FIG. 1.

In forming the package illustrated in FIG. 1, the bottles B are assembled in double row transversely aligned pairs and a wrapper or carton forming blank 12 which is cut and scored as shown in FIG. 7 is first positioned with the top wall forming panel 22 on the top of the bottle assembly and with the top separating panels or tab members 38 and 38' depending between the transversely aligned pairs of bottles. The sidewall forming panels are folded down about the sides of the bottle assembly and the bottom wall forming panels 25 and 26 are turned inwardly with the terminal panel 28, which constitutes the bottom partition panel, being swung to an upstanding position (FIGS. 1, 3, 5, 7 and 8) and inserted between the bottom edge portions of the bottles in the two rows thereof. The other terminal panel 27 is swung to a vertically directed downwardly extending position. The panel 26 is brought into bottom wall forming position ahead of the panel 25 and these panels are moved inwardly toward each other so that the tab member 56 which forms a primary male locking element is inserted in the aperture formed by cutting on the line 70 which constitutes the female locking element for cooperation with the locking element 56. The locking tab member 56 is initially in the plane of the panel 27 and engages the edge portion 71 of the aperture which serves as a fulcrum as the terminal panel is laid down, or plowed down, onto the outside face of the apertured portion of the panel 26 with the latching tabs 57 and 57', which serve as secondary locking or latching means, being inserted in the cooperating apertures 73 and 73' and trapped beneath the bottoms of the bottles which are upwardly bowed sufficiently to permit the positioning of the tab members 57 and 57' with the blank tightly drawn or tensioned so as to hug the bottles and form a tight package. As shown in FIG. 5 the small tab 68 which is formed by cutting on the line 70 will be bent inwardly to a certain degree by insertion of the locking tab element 56 and will serve to resist withdrawal of the element 56. The blank may be applied manually but it is especially designed for application by high speed packaging machinery such as disclosed in U.S. Pat. Nos. granted to R. H. Ganz 3,474,590 dated Oct. 28, 1969 and 3,456,420 dated July 22, 1969. A tight wrap about the bottles is obtained by internal pressure applied to the edges 54, 54' and 55, 55' of the bottle bottom retaining apertures 42, 42' and 43, 43' or by external pressure applied to adjacent portions of the wall panels and manipulation of the locking and latching elements may be accomplished by plows on a continuously traveling packaging machine.

The blank may be, of course, of a size to package a larger number of articles than the four illustrated, in which event, primary locking elements will be spaced so as to fall in the areas between adjoining pairs of transversely spaced articles and the secondary locking elements will be spaced so as to align approximately with the vertical center lines of each pair of articles. Also a different arrangement may be provided in the top wall forming panel for retaining and for separating the tops of the articles. While the end panels of the blank in the form shown, are folded beneath the bottle assembly and form the bottom wall the blank may be cut and scored to have the end panels form the top wall of the package.

I claim as follows:

1. In a package for a plurality of articles in the form of bottles which are arranged in double row transversely aligned pairs, a wrapper formed by a blank of paperboard or the like which is cut and scored to provide wall and partition forming panels, the wall forming panels being adapted to fold about the top, sides and bottom of an assembly of the articles with said blank having two opposed blank end panels having wall forming portions, one of said blank end panels having a narrow hinged terminal panel adapted to be hinged to a partition forming position to separate the articles in the two rows and the opposed blank end panel having a narrow hinged terminal panel forming a locking panel with locking and latching elements on outermost edges thereof which are adapted to interengage in locking and latching relation with cooperating locking and latching elements in the partition forming blank end panel, wherein said hinged terminal locking panel has a primary locking element on the hinged edge thereof and secondary latching elements on the terminal edge which are in offset relation relative to the primary locking element.

2. In a package as set forth in claim 1 wherein the locking and latching elements on the partition carrying blank end panel comprise apertures in wall forming portions thereof and a tab member which is cut from portions of the partition panel and slotted to receive the primary locking element.

3. In a package for a plurality of articles in the form of bottles which are arranged in double row transversely aligned pairs, a wrapper formed by a blank of paperboard or the like which is cut and scored to provide wall and partition forming panels, the wall forming panels being adapted to fold about the top, sides and bottom of an assembly of the articles with said blank having two opposed blank end panels having wall forming portions, one of said blank end panels having a narrow hinged terminal panel adapted to be hinged to a partition forming position to separate the articles in the two rows and the opposed blank end panel having a narrow hinged terminal panel forming a locking panel with locking and latching elements on outermost edges thereof which are adapted to interengage in locking and latching relation with cooperating locking and latching elements in the partition forming blank end panel, wherein said article separating partition has cut therein a relatively small tab formation which remains in the plane of the associated wall forming panel portion when said article separating partition is swung to article separating position and said tab formation has aperture forming means cut therein for cooperation with a locking and latching element on said locking and latching panel.

4. A container forming blank for wrapping about an assembly of articles having the form of bottles which are arranged in double row transversely paired relation, said blank being formed from a generally rectangular sheet of foldable paperboard material which is cut and scored on parallel spaced hinge forming score lines to provide a center wall forming panel having a dimension between the panel defining score lines which is somewhat less than the width of the article assembly, adjoining side wall forming panels and end panel sections adapted to be connected so as to form a tubular container when wrapped about the assembly of articles, each of said end panel sections being subdvided by a transverse hinge forming score line to provide a terminal end panel strip, one of which is adapted to be hinged to a position to serve as a partition for separating the rows of bottles, and the other one of which has locking and latching tabs on outermost edges thereof, and said partition carrying blank section having means forming apertures therein for receiving the locking and latching tabs on said end panel strip so as to enable said end panel strip to serve as a connecting means for said end panel sections.

5. A container forming blank as set forth in claim 4 wherein said center wall forming panel has cut therein generally rectangular tab elements with transverse hinge lines centered between the panel forming score lines which tab elements are adapted to be swung on said hinge lines to a position for separating the top portions of a pair of the articles.

6. A container forming blank as set forth in claim 4 wherein said side wall forming panels have apertures cut therein at the junction with said center panel which are adapted to receive edge portions of the articles and serve as article retention means when the blank is wrapped about the articles.

* * * * *